106-89 AU 115 EX
1/10/78 XR 4,067,939

United States Patent [19]
Lowe et al.

[11] 4,067,939
[45] Jan. 10, 1978

[54] CASTING OF ARTICLES CONTAINING CALCINED GYPSUM

[76] Inventors: James N. Lowe, Quarry Hill House, 48 Gatton Road, Reigate, Surrey, England; Byron C. Grebe, 3981 Glendale Drive, Memphis, Tenn. 38128

[21] Appl. No.: 591,004

[22] Filed: June 27, 1975

[30] Foreign Application Priority Data

Aug. 7, 1974 United Kingdom ..... 34831/74

[51] Int. Cl.[2] ..... B28B 1/14
[52] U.S. Cl. ..... 264/42; 106/89; 106/90; 106/110; 264/87; 264/133; 264/333; 264/DIG. 43
[58] Field of Search ..... 264/333, 86, DIG. 59, 264/DIG. 43, 87, 133, 42, 40.6; 106/73, 88, 110, 89, 90

[56] References Cited

U.S. PATENT DOCUMENTS

| | | | |
|---|---|---|---|
| 2,310,023 | 2/1943 | Gardner | 106/110 |
| 2,533,263 | 12/1950 | Johnson | 264/87 |
| 2,681,863 | 6/1954 | Croce | 264/86 |
| 2,753,608 | 7/1956 | Nolan | 264/86 |
| 2,882,175 | 4/1959 | Baily | 106/88 |
| 2,921,862 | 1/1960 | Sucetti | 106/88 |
| 3,427,374 | 2/1969 | Jackson et al. | 264/133 |
| 3,770,859 | 9/1973 | Bevan | 264/333 |
| 3,808,299 | 4/1974 | Svensson | 264/333 |
| 3,873,332 | 3/1975 | McCreight | 106/110 |
| 3,957,522 | 5/1976 | Matsuo et al. | 264/87 |

OTHER PUBLICATIONS

Lea et al., The Chemistry of Cement and Concrete, pp. 18, 248 and 249, 1956.

*Primary Examiner*—Robert F. White
*Assistant Examiner*—John A. Parrish
*Attorney, Agent, or Firm*—Brisebois & Kruger

[57] ABSTRACT

A method of making a cast article from a composition which contains a hydraulic binding agent comprising by weight from 90% to 10% calcined gypsum and from 10% to 90% Portland cement comprises mixing the composition with water to produce a fluid mixture, either the water or some at least of the components of the composition or both being heated so that the mixture has a temperature of from 70° to 130° F, and pouring the fluid mixture into a mould or other supporting device where the reaction of the calcined gypsum with the water causes the mixture to set and the heat of this reaction causes the temperature of the mixture to begin to rise. As soon as the mixture has set sufficiently to be self supporting, the set mixture, which forms the cast article, is removed from the mould or other supporting device and then the dissipation of both heat and moisture from the cast article is controlled so that the temperature of the article continues to rise to from 90° to 180° F. This temperature is maintained for a period of at least two hours to allow the moisture in the article to cure the cement. Preferably the dissipation of heat and moisture from the cast article is controlled by confining the cast article in a heat and moisture insulating jacket which maintains an atmosphere of 100% relative humidity around the article. After the temperature and moisture content has been maintained to cure the cement, the cast article is dried either by the application of a vacuum to a part at least of its surface or by causing air to flow over its surface while the article is still hot.

27 Claims, 4 Drawing Figures

CASTING OF ARTICLES CONTAINING CALCINED GYPSUM

Figure 1:
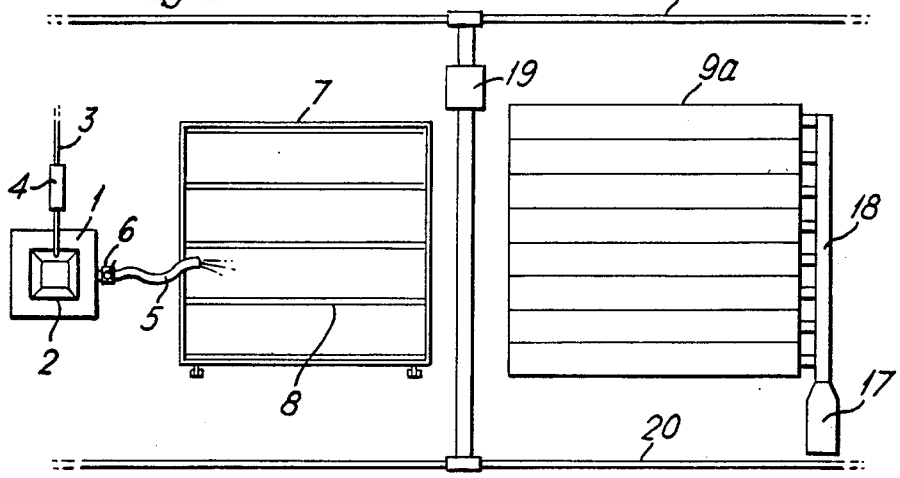

Materials such as concretes and mortars containing a hydraulic binding agent comprising a mixture of calcined gypsum, which is gypsum partially dehydrated by means of heat and having the approximate chemical formula $CaSO_4 \cdot \frac{1}{2}H_2O$, and Portland cement with or without a mineral aggregate or other inert filler have been developed for various purposes where quick setting and a very rapid attainment of some compressive strength are required. Both the quick setting and early strength characteristics are provided by the calcined gypsum content and subsequently the cement provides a further substantial increase in strength as it is cured.

These materials have been used for repairing roads and aircraft run-ways and attempts have also been made to use them for making cast articles, particularly pre-cast building and other construction units. While such materials have a number of advantages over normal concretes and mortars containing a binding agent consisting solely of cement, their use has so far tended to be uneconomic owing to the relatively high cost of calcined gypsum compared with Portland cement.

We have now, however, discovered a technique for casting articles from such compositions which overcomes the economic disadvantages mentioned above. To this end, according to our invention, an article is cast by a method comprising the steps of mixing a composition comprising a binding agent containing, by weight, from 90 to 10% calcined gypsum and from 10 to 90% Porland cement with water to produce a fluid mixture, either the water or the components of the composition or both being heated so that the mixture has a temperature of from 70° to 130° F, pouring the fluid mixture into a mould, form, or other supporting device, where the reaction of the calcined gypsum and the water causes the mixture to set, and the heat of the reaction causes the temperature of the mixture to begin to rise, removing the mixture from the supporting device after the mixture has set sufficiently to be self supporting and controlling the dissipation of both heat and moisture from the set mixture so that the temperature of the set mixture rises to from 90° to 180° F and the temperature and moisture content of the mixture is maintained for a period of at least two hours to cure the cement.

Once the calcined gypsum content of the binding agent has reached its final set, that is to say it has been fully hydrated, this component of the binder reaches its maximum moise compressive strength. The subsequent gain in compressive strength which takes place during curing is brought about entirely by hydration of the Portland cement component of the binding agent. However, as the gypsum component of the binding agent is dried, its compressive strength increases. Preferably therefore in the method in accordance with the invention, after the set mixture has been maintained moist and at a raised temperature for its period of at least two hours, drying of the mixture is then brought about. This may be effected by the application of a vacuum to one or more surfaces of the cast article or it may be effected by causing air to flow over a part or the whole of the surface of the cast article while it is still hot or by a combination of these two techniques. When drying is effected by an air flow, and it is preferred to do this even when a vacuum is applied initially to start the drying process, the heat produced in the article by the initial mix temperature and the subsequent exothermic reaction is thus used to evaporate part at least of the moisture in the article into the flowing air stream. In this way the whole of the heat energy in the mix is used efficiently and the total energy consumption of the casting technique is kept to a minimum. The curing time during which the dissipation of heat and moisture is controllled and the subsequent drying time are both varied in dependence upon practical requirements to maintain the required rate of production. To maintain steady utilisation of plant, it is desirable for the full cycle time for the production of a cast article to be 8, 16 or 24 hours. An 8 hour cycle may consist of five hours curing time and three hours air drying or seven hours curing time followed by 1 hour of vacuum drying. A twenty-four hour cycle may include 20 hours curing time and 4 hours air drying; 23 hours curing and one hour vacuum drying or a curing period between twenty and twenty-three hours followed by 1 hour vacuum drying and some air drying time to make a total of 24 hours. In all cases, though, the curing time during which the dissipation of heat and moisture is controlled is preferably at least 3 hours and more usually about six hours.

We have found that by heating the mixture and conserving the heat and moisture for curing purposes, it can be made possible to remove the cast mixture from the mould or other supporting device much more quickly than is possible with normal concrete mixes. The actual time from casting to removal may vary widely according to the size of the casting and other requirements, for example, from 2 or 3 minutes for small articles to several hours for large slabs, but in all cases it is possible to make a more rapid series of re-uses of the mould or other supporting device than is possible when casting similar articles using conventional techniques.

At the end of the curing time, which is dependent upon the exact nature of the cast composition and the temperature at which it is maintained, about one-half of the final dry compressive strength of the composition can be achieved although it may sometimes be rather less and sometimes up to three-quarters. At the end of the curing time, the articles can be handled, transported and used with little or no further delay. In this way the capital costs involved in the moulds or other casting supports are very much less than those involved in the manufacture of ordinary pre-cast concrete articles and further economies accrue because it is no longer necessary to maintain large stocks of cast articles awaiting maturity. Because of the economies achieved in this way, articles made by the method in accordance with the invention can compete very successfully from the cost point of view with normal pre-cast concrete articles and they have further considerable advantages insofar as the versatility of the material is concerned. The mixture can be made much more fluid than can a normal concrete or mortar mix containing only Portland cement as a binding agent and in consequence the labour costs involved in placing the material in the mould or other supporting device is greatly reduced. In most cases it is only necessary to pour the material into the supporting device and no vibration or other compaction is required. Because of the fluidity it is also possible to cast thinner sections and have closer reinforcement than can be done with normal concrete or cement mortar.

A content of 10% of calcined gypsum in the dry binding agent is the minimum necessary to give a rapid set to make the cast article self-supporting. Preferably, however, the calcined gypsum content of the dry binding agent is substantially greater than 10% and a content of 40 or 50% is preferred. In addition to the calcined gypsum and the Portland cement, the binding agent may also include some Pozzolana cement and is some circumstances this improves the durability of the cast articles. The Pozzolana cement content may be from 0 to 15% by weight of the total binding agent and when included it takes the place of some of the Portland cement.

In order to avoid deterioration of the hardened cement content of the cast article owing to the presence of the gypsum when the cast article is likely to become moist, for example when the article is a building component for exterior use, it is important that the Portland cement should be of the sulphate resisting variety. Further, it is most desirable that the cement, whether sulphate resisting or not, should be finely ground and have a high specific surface. For most purposes, it is preferable that the specific surface should be at least 450 $m^2/Kg$. For higher strengths an even greater specific surface of up to 740 $m^2/Kg$ should be used. The reason for using finely ground cement with a high specific surface is that such cement hydrates more rapidly than less finely ground cement and in consequence a high proportion of the cement is hydrated in the relatively short curing period at which the cast article is maintained hot and moist. During subsequent drying, the moisture content may be reduced as low as 2% by weight and when this happens no further hydration of the cement can take place.

The time taken for the cast composition to become self-supporting from the moment of mixing the binding agent with water may vary widely. Generally it will be only from 4 to 10 minutes when casting small articles or continuously casting sheeting as may be done on a moving belt. This is necessary from an economic point of view when it is possible to take advantage of it. What is more, the shorter the setting time, the less heat loss there will be from the cast composition and the more rapid the subsequent cure of the cement will become.

When casting more extensive articles however, such as large slabs, it is desirable to finish casting before setting occurs. In this case a retarder is added to the composition and indeed the amount of retarder added may be decreased as casting proceeds, so that after casting is complete, the whole of the cast mass then sets at substantially the same time.

When casting normal concretes or mortars containing only Portland cement as the binding agent, most codes of practice specify that the initial mix temperature should not be above 75° F and what is more, when the cast material is subsequently heat cured, there is a requirement that no heat should be applied until 3 hours have elapsed from the time of casting and even then the temperature should only be raised at a rate of 1° F per minute up to the final curing temperature of about 140° to 160° F which is then maintained. If this rate of heat application is exceeded, or if heating is started too soon after casting, it has been found that cracking of the cast article is brought about by the induced temperature stresses.

We believe, however, that the cracking is caused because the curing heat is applied externally and our present invention is largely based on our discovery that by using the curing heat which is partly present initially in the mixture and is subsequently increased internally by the heat of the exothermic reaction of the water and the calcined gypsum, it is feasible to start with a mix heated to a temperature in the range set out and to allow this temperature to start to rise immediately and that by so doing no cracks are caused by temperature stresses and curing of the Portland cement in the binder is enormously expedited.

For manufacturing structural components which, in use, are highly stressed, the cast composition may contain a hard mineral aggregate, but when this is done, the fluidity of the mixture is greatly reduced. To overcome the difficulties caused by lack of fluidity, the fluid composition with no hard aggregate filler may be added to a mass of aggregate or other coarse filler already in place in the mould or other supporting device. Preferably, however, the mixture contains no aggregate, but may have air entrained in it to increase its bulk. For stressed structural components, the final density may then be from 110 to 120lb. per cu. foot and this material may be pre-stressed after it has hardened in the same way as normal pre-cast concrete beams are pre-stressed. For making components such as wall panels which are subjected to lower stresses, more air may be entrained in the mix and in this case the air entrainment may be such that the final density of the cast product is from 80 to 90lb. per cu. foot. For making heat insulating panels, the air entrainment can be increased still further and it is possible to obtain a density as low as 15 to 20lb. per cu. foot. Indeed one of the many advantages of articles cast by the method in accordance with the invention lies in the wide variation of properties that can be achieved by comparatively minor variations in the composition of the material and in the mixing operation itself.

Various types of calcined gypsum may be used in the composition which is cast by the method in accordance with the invention and the type selected will depend upon the required final strength of the cast article. Thus for only lightly stressed articles, commercial grade atmospherically calcined gypsum, which is known as $\beta$ may be used but where a higher compressive strength is necessary, for example when the article is to be prestressed, a high strength autoclaved $\alpha$ or $\alpha+$ may be used. These high strength gypsums are made by heating hydrated gypsum, which may be either naturally occurring gypsum rock or the product of a chemical process, for example phosphogypsum, in an environment saturated with water vapour in an autoclave at about 270° F or higher. The main difference between the $\alpha$ gypsums and the atmospherically calcined $\beta$ gypsums lies in their morphology. High strength $\alpha$ gypsums comprises well crystallised prisms of hemihydrate while the $\beta$ gypsums consist of very small crystals of hemihydrate held together in porous conglomerates.

Preferably the dry components of the composition together with water are mixed in a paddle mixer at a speed somewhat higher than is customary for such mixers. The mixing speed is preferably over 40 r.p.m. and the best results are achieved at a speed from 50 to 55 r.p.m. Air entrainment is achieved in the mix by the addition of an air entraining agent and this is preferably used in an amount not less than 0.01% by weight of the water added to the binding agent. We have found that sodium lauryl sulphonate produces the best results, but other conventional air entraining agents may be used. The agent is preferably added as a preliminary thicknening of the mix takes place during the mixing operation at a time when between 80 and 90% by weight of the dry materials have been added to the water. When this is done, the later addition of the remaining part of the dry materials of the mix breaks down the larger weak voids produced by the air entraining agent leaving extremely small uniform voids in the wet mixture and subsequently in the cast article.

Various other additives in addition to air entraining agents may be incorporated in the composition and amongst these are wetting or fluidising agents to increase the fluidity of the wet composition for a given water content, fibres for reinforcing purposes including energy from shock loads, local or otherwise, and in this respect sisal fibres have been found to be very satisfactory, and also accelerators or retarding agents may be added according to whether a very rapid or a slower setting of the mix is required. The setting time required is dependent upon a number of factors and in particular upon the size of the article being cast.

Two preferred fluidising agents are Gum Arabic and a sulphonated melamine formaldehyde resin, an example of which is a material called "Melment" which is supplied by SKW of Trastberg, West Germany. The inclusion of a fluidising agent in the mixture increases the fluidity of the mixture to such an extent that it is possible to use only 35 parts by weight of water to 100 parts by weight of dry binding agent although the water content has to be increased when the composition is aerated. The reduction in water content gives rise to a substantial increase in the final compressive strength above that achieved with a mix of the same fluidity produced by an increase in the water content. The proportion of Melment or Gum Arabic required in the mix is determined experimentally and is the minimum to give the required fluidity at the desired water content in dependence upon the density and the method of casting. This will generally result in a content of from 0.1% to 0.5% by weight of dry binding agent when using autoclaved $\alpha$ gypsum and from 0.5% to 2.0% when using atmospherically calcined $\beta$ gypsum.

A preferred retarding agent, for retarding the setting time as is usually necessary, is sodium citrate. The amount of sodium citrate necessary varies with the nature of the Portland cement used and in particular upon the raw gypsum content, if any, in the Portland cement since this acts as an accelerator of the setting of the calcined gypsum. For most purposes a maximum of 0.1% by weight of the dry binding agent is required.

Some retarding effect is produced by the air entraining agent when this is used, and in consequence when the mix contains a high proportion of air entraining agent, to give a low density, an accelerator may be necessary in the mix in place of the sodium citrate. A preferred accelerator is potassium sulphate and the content may then be up to 0.1% of the weight of dry binding agent.

Material in which air is entrained to an extent such that the density is below about 100lb. per cu. foot, has the great advantage that it can be worked by ordinary wood-working tools. Thus it can be sawn, drilled or routed and both nails and screws can be driven into it. This is extremely advantageous in the case of building panels for internal or external walls as it enables window and door openings to be cut out wherever required and for fixings to be made to the panels with a minimum of labour. A sisal or other fibre content in the mix helps to prevent any local cracking which might otherwise occur and the sisal fibre content may be up to 2% by weight of the dry binding agent.

Building panels made by the method in accordance with the invention may be used as cast for internal partitions and for other internal purposes where they will not be subjected to weathering. For external purposes, however, it is necessary for the faces of the panels or other articles which are likely to become wet to be sealed. This sealing is preferably achieved, according to a further preferred feature of the invention, by the application to the surface to be sealed of a moisture curing liquid synthetic resin after the composition has set and either before or after the curing period, but before drying. At this stage the surface of the article is extremely porous with fine pores which produce a capillary action and suck the uncured liquid resin into the surface of the article. The absorption is considerable so that the resin impregnation of the composition takes place for a depth of up to about ¼ inch from its surface. The resin is then cured by the moisture in the composition and further, it is baked in the pores and hardened by the heat still contained in the composition and produced by the exothermic reaction of the calcined gypsum and water.

Generally speaking it has previously been thought that in order to produce a waterproof skin on gypsum containing articles it is necessary to produce an impervious film covering the surface to be waterproofed. We have found, however, that far better results are achieved by applying the resin in the manner just described so that it is drawn in by the capillary action of the damp gypsum to impregnate the surface layer. A moisture curing polyurethane is preferred for this purpose.

To make the composition still further resistant to deterioration by weathering or other wetting, particularly should the cast composition suffer from any cracking, which is particularly common in building structures, a wax or acrylic resin emulsion may be incorporated in the wet mix. This is preferably used in an amount up to 2% by weight of the dry binding agent. Both these resins give risistance to attack by water to the hardened composition and the wax resin also helps to increase the fluidity of the wet mix and retards the set and thus when it is incorporated it may make the inclusion of both sodium citrate and Melment or Gum Arabic unnecessary. Weight for weight it is much cheaper than both of these materials.

In order to maintain the moisture content and restrict the heat dissipation from the cast composition during the period in which the cement is cured, the cast article is preferably confined in a heat and moisture insulating jacket which maintains an atmosphere of 100% relative humidity around the article so that once the humidity has built up within the jacket, no further moisture loss takes place.

When one face of the panel or other article is sealed with moisture curing polyurethane or other synthetic resin directly after the article has been removed from its mould, the escape of moisture from this face is prevented and the subsequent curing is in consequence facilitated.

As the cured article is dried, either by causing air to flow over it, or by applying a vacuum to its surface, the moisture content is preferably reduced to from 2 to 10% by weight and is preferably then maintained at this level as we have found that any further reduction is inclined to give rise to surface cracking. It is of course essential that not the whole of the surface of the article should be sealed with polyurethane or other synthetic resin until drying has taken place to the required moisture content and therefore in the case of a panel only one face should be so treated. Where it is required to apply paint or other finishes to the unsealed face of a building panel or other article, this face is preferably subsequently coated, after drying, with an acrylic resin emulsion which itself contains about 50% of acrylic resin by weight and may also have about 10% by weight of cement mixed with it. This emulsion is also drawn into the surface of the article by the suction effect of the gypsum although this suction is not so great once the article has dried. The acrylic emulsion partially closes the pores on the surface of the article and the cement increases the degree of closure. When cured, the resin produces a surface to which paint or adhesives can be applied, that is to say the surface is sealed against dusting but is not sealed against the escape of moisture. The drying out of the water from the emulsion causes the acrylic resin impregnated surface to be somewhat porous so that the panel can still "breathe" and any residual moisture above the preferred content of 2 to 10% by weight can still dry out.

Figure 2B:
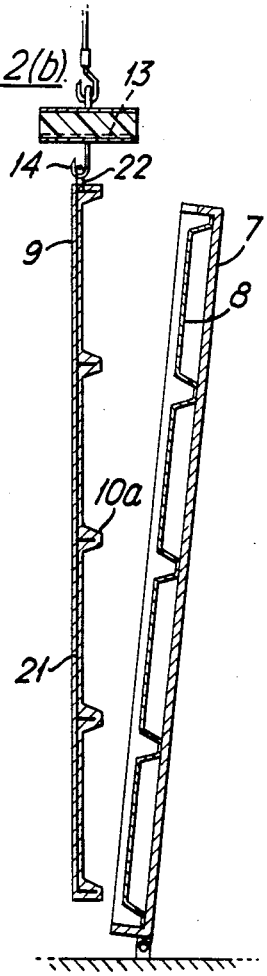
Figure 2C:
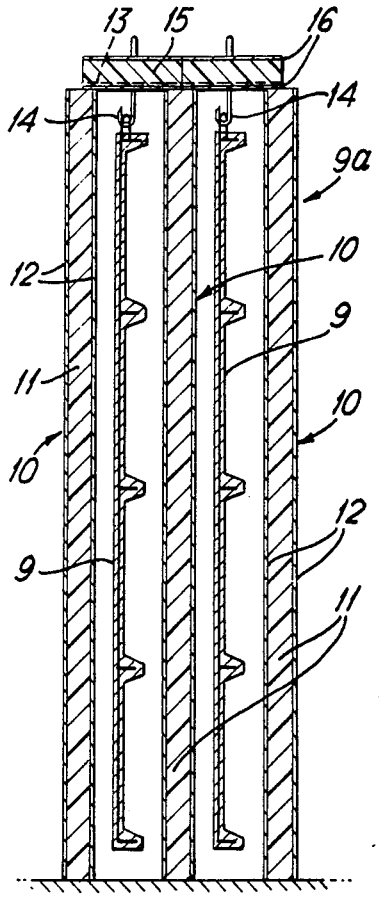
Figure 2A:
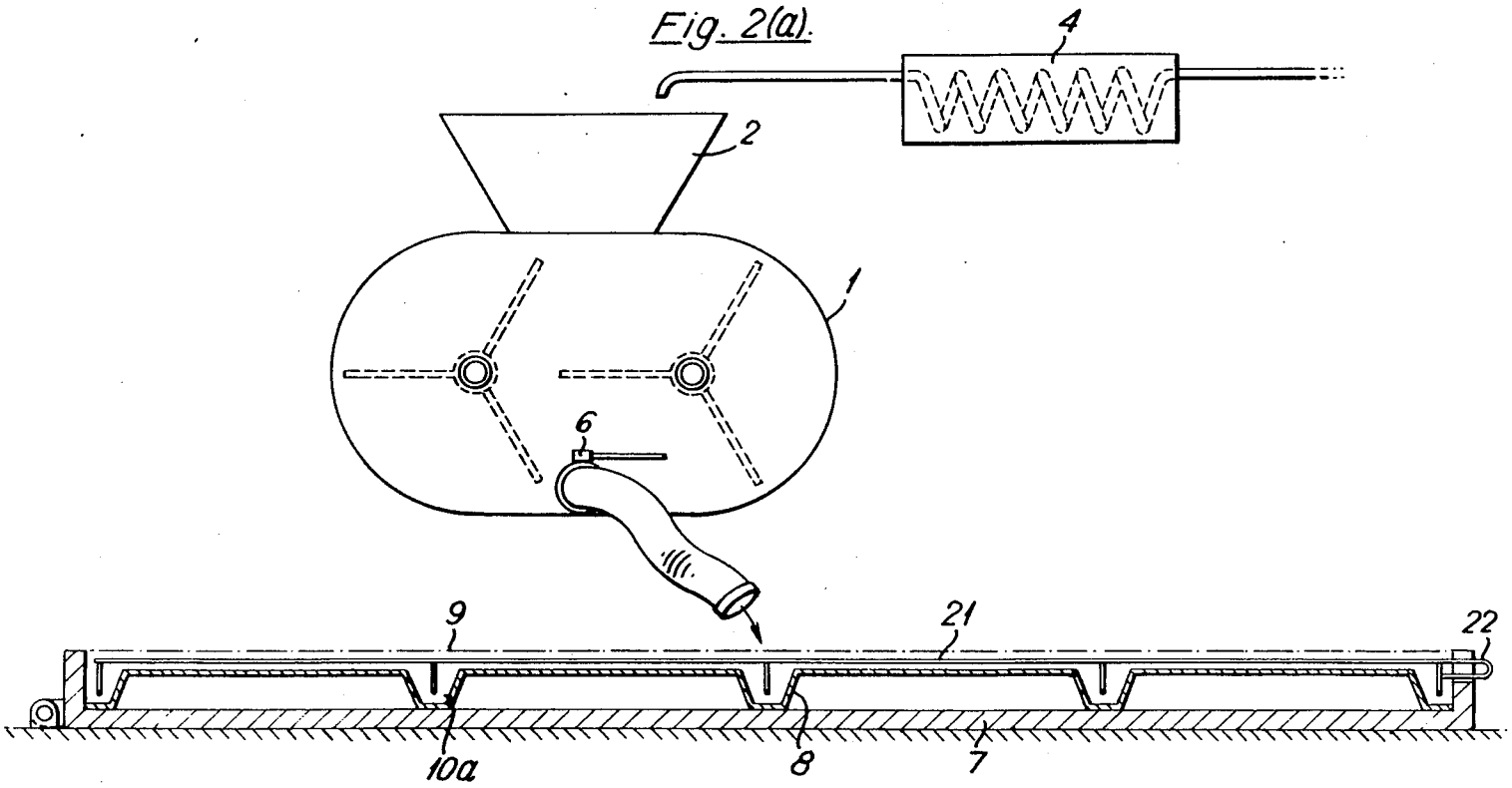

An example of the construction of a building panel by a method in accordance with the invention will now be described with reference to the accompanying diagrammatic drawings, in which:

FIG. 1 is a plan view of the layout of the plant for making the panels; and,

FIGS. 2(*a*) to 2(*c*) are side views of parts of the plant illustrating the sequence of operations in the manufacture of a single panel.

The plant shown by way of example in the drawings is of a simple type suitable for installation on a building site for the construction of building panels and other components for the construction of a substantial number of buildings. Where the plant is to be installed in a permanent factory for the continued supply of building panels or other articles for transport elsewhere, a more sophisticated plant incorporating more extensive mechanical handling may be used. In particular, of course, various components of the plant can be duplicated or provided in still greater numbers to provide any required production rate.

The plant illustrated diagrammatically in the drawings comprises a mixer 1 of the contra-rotating double-paddle type with a feed hopper 2 and a water supply 3 provided with a heater 4. The mixer 1 has a flexible outlet pipe 5 fitted with a shut-off cock 6 and adjacent the outlet pipe 5 is a pivotally mounted tilting moulding table 7 provided with a mould 8.

The mould 8 is of timber coated with plastics material, of rigid polyvinyl chloride or of other material which is a poor conductor of heat so that it takes as little heat as possible from the mixture as its temperature rises. The mould may be pre-heated but this is not generally necessary. As shown most clearly in FIG. 2(*a*), the mould 8 in this example is shaped to form a building panel 9 having a flat upper surface and five parallel stiffening ribs 10*a* on its underside.

On the side of the moulding table 7 remote from the mixer 1 is a heat and moisture insulating jacket structure 9 comprising eight compartments arranged side by side and each of such a size that it can hold and quite closely surround a panel from the mould 8. Details of the jacket structure are shown most clearly in FIG. 2(*c*) which is a vertical section through one end of the jacket structure showing two of its compartments. The remaining six compartments are similar. The jacket structure 9*a* comprises a series of walls 10 made of slabs of foamed polystyrene 11 covered on both sides with polyethylene sheeting 12. The foamed polystyrene provides the heat insulation and the polyethylene sheeting makes the walls waterproof to maintain the moisture content of the atmosphere within the compartments. The walls 10 further comprise upright steel stanchions at intervals and these stanchions support the slabs of foamed polystyrene 11 and also support cross beams 13 to which supporting hooks 14 are fixed. Fixed to and in between the cross beams 13 are further foamed polystyrene slabs 15 covered with polyethylene sheeting 16 to form covers for the compartments between the walls 10. The beams 13 with the parts of the slabs 15 attached to them and the other slabs are removably for access purposes to the compartments. The ends of the compartments are closed by further slabs of foamed polystyrene covered with polyethylene sheeting.

The ends of the compartments adjacent the moulding table 7 may also be detachable to improve the access to the compartments between the walls 10, but the ends of the compartments remote from the moulding table 7 are fixed in position and here a fan 17 blows air to a manifold 18 having branches leading one to each of the eight compartments. The branches from the manifold 18 enter the compartments near the bottoms of their end walls.

A gantry crane 19 running on rails 20 spans the whole of the area occupied by the mould table 7 and the jacket structure 9*a*.

To manufacture a building panel 9, a cage of steel reinforcement 21 incorporating a lifting eye 22 is fixed in position in the mould 8 in the usual way. With the shut-off cock 6 closed a part of the water required for the mix is supplied to the mixer 1 and is pre-heated by the heater 4 to the required temperature. Next the dry ingredients of the mix, which together with other details will be described later, are supplied gradually to the mixer 1 through the hopper 2. To avoid errors in mix proportions in a site plant, the dry ingredients may be pre-mixed and bagged. The paddles of the mixer 1 are set in motion just before the supply of the dry ingredients starts and during the supply, further wet ingredients as may be required together with the required proportion of foaming agent and the remainder of the heated water is added to the mixer 1. When mixing is complete, together with any high speed rotation of the paddles of the mixer necessary to incorporate air into the mix, the cock 6 is opened and the mix which is of a very fluid consistency is supplied to the mould 8 with the moulding table 7 in a horizontal position as shown in FIG. 2(*a*).

Since the mix is very fluid, it will to a large extent find its own level to provide a smooth flat top for the panel 9 but some final screeding of the top surface together with slight vibration of the moulding table may be used to expedite the flow of the mix over the whole mould. The mould may then be covered with a heat insulating cover to keep in the heat produced by the reaction between the calcined gypsum and the water.

As soon as the calcined gypsum content of the mix has set, the panel 9 immediately has sufficient strength to be self-supporting and the moulding table 7 is tilted into an upright position as shown in FIG. 2(*b*) and the crane 19 lifts the panel 9 from the mould. The crane 19 is connected indirectly to the lifting eye 22 of the panel 9 through a cross beam 13 and a hook 14 forming part of the top of the jacket structure 9*a*. As soon as this has been done, the moulding table 7 can be lowered to its horizontal position so that it is immediately ready for fixing the reinforcement and the subsequent casting of the next panel. In the meantime the panel 9 is supported by the crane 19 in an upright position, but with its lower end resting on the floor of the plant beside the moulding table 7 and, if required, one face of the panel 9 is sprayed with a moisture curing liquid polyurethane. This liquid resin is sucked into the pores of the hot and moist set composition forming the building panel and an application rate of 1 liter/sq.meter is typical to obtain maximum waterproofing but in many cases an application of 0.1 liter/sq.meter may be all that is required.

As soon as the application of the liquid polyurethane has been completed, and this is effected as quickly as possible, the panel 9 is lifted by the crane 19 into one of the compartments of the jacket structure 9*a*. The panel 9 is lowered into the compartment from above with the cross beam 13 resting on the top of two stanchions to support the panel and at once the remainder of the slabs 15 are placed in position to close the compartment completely. The sizes and shapes of the compartments of the jacket structure 9*a* are made so that the panels 9 fit closely within them within practical limits to make for ease of handling. In the example illustrated, the maximum thickness of the panel 9 and of the ribs 10 is 100 mm and the compartments are each made 200 mm wide to provide a clearance of approximately 50 mm at each side. The heat excape from the compartments is minimal and there is no moisture escape so that very rapidly the relative humidity of the air in the compartment to which a panel has just been supplied reaches 100% and the temperature produced by the exothermic reaction of the materials in the mix rises to from 90° to 180° F.

The panel is kept in its compartment of the jacket structure 9*a* for the time required for curing the cement content of the panel and then the fan 17 is set in operation and the branch of the manifold 18 leading to the compartment is opened. A slab 15 at the end of the compartment remote from the manifold 18 is removed so that air is blown through the compartment over the surfaces of the panel 9 so that it is gradually dried. When one face of the panel had moisture curing polyurethane resin incorporated in it, the resin is cured during the curing time of the cement and no moisture escapes from this face. Since drying therefore takes place only from the other face, the drying time will be increased substantially above that which occurs when there is no polyurethane impregnation.

As an alternative to drying by blowing air through the compartments of the jacket structure 9*a*, when curing is complete, the whole of the top of the compartment may be removed and a conventional vacuum drying sheet may be lowered into the compartment and applied to that face of the panel which has not been impregnated with polyurethane resin. A vacuum pump is applied to the vacuum sheet and moisture is very rapidly sucked from the panel. This decreases the overall time for the manufacture of the panel.

The mix used in constructing the panel 9 will depend upon the use to which the panel is to be put and in particular whether the panel is to be used for structural load bearing purposes or not and whether the panel is for forming an interior part of a building or whether it is to be used on the exterior of a building where it is exposed to the weather, and in particular to rain.

Panels were made using four different mixes as follows:

Example I

| | |
|---|---|
| Autoclaved Calcined Gypsum | 50 lb. |
| Atmospheric Calcined Gypsum | 25 lb. |
| Finely-Ground Sulphate-Resisting Cement | 25 lb. |
| Melment | 0.3 lb. |
| Sisal Fibre | 0.5 lb. |
| Foaming Agent (Sodium Lauryl Sulphonate) | 0.04 lb. |
| Sodium Citrate | 0.05 lb. |
| Wax Resin (in an emulsion) | 1 lb. |
| Water | 42 lb. |

Example II

| | |
|---|---|
| Autoclaved Calcined Gypsum | 50 lb. |
| Atmospheric Calcined Gypsum | 25 lb. |
| Rapid Hardening Cement | 25 lb. |
| Melment | 0.3 lb. |
| Sisal Fibre | 0.5 lb. |
| Foaming Agent (as above) | 0.3 lb. |
| Sodium Citrate | 0.05 lb. |
| Water | 41 lb. |

Example III

| | |
|---|---|
| Autoclaved Calcined Gypsum | 50 lb. |
| Finely-Ground Sulphate-Resisting Cement | 50 lb. |
| Melment | 0.3 lb. |
| Sisal Fibre | 0.5 lb. |
| Foaming Agent (as above) | 0.05 lb. |
| Sodium Citrate | 0.05 lb. |
| Wax resin (in an emulsion) | 1 lb. |
| Water | 38 lb. |

Example IV

| | |
|---|---|
| Autoclaved Calcined Gypsum | 50 lb. |
| Rapid Hardening Cement | 50 lb. |
| Melment | 0.3 lb. |
| Sisal Fibre | 0.5 lb. |
| Foaming Agent (as above) | 0.3 lb. |
| Sodium Citrate | .03 lb. |
| Water | 36 lb. |

It will be seen that in Examples I and II the same gypsum constituents were used and this was also the case in Examples III and IV. In Example I and Example III the cement is sulphate-resisting and in Examples II and IV the cement is rapid hardening and this is preferably particularly finely ground as already described. With all mixes, either rapid hardening or sulphate-resisting cement may be used, but in all cases where there is a possibility of moisture penetrating the cast article in use, sulphate-resisting cement should be used. Further, where there is the possibility of the cast article getting damp, a wax resin emulsion is added to the mix as in Examples I and III. Further, in all cases the Melment content may be substituted by Gum Arabic in approximately the same amount and similarly the sodium citrate content may be substituted by some other retarder commonly used for retarding the setting of the gypsum. The other essential difference between Examples I and III on the one hand and Examples II and IV on the other hand, is that the foaming agent content of Examples II and IV is very much greater to produce a lower final dry density. In Examples I and III this was approximately 100 lbs. per cu. foot and in Examples II and IV, 70 lb. per cu. foot.

With all four mixes the same mixing procedure was adopted and this was as follows:

| Operation | Time Elapsed |
|---|---|
| (a) 90% of water added to paddle mixer. | |
| (b) Sodium citrate dissolved in water in mixer. | |
| (c) Mixer operated at 40 RPM. 90% of dry materials added. | Datum Time D |

-continued

| Operation | Time Elapsed |
|---|---|
| (d) Mix for 1 minute. | 1 Min. |
| (e) Foaming Agent and furter 10% of water added to mixer. | |
| (f) Mixer speed increased to 55 RPM: mix for 30 seconds. | 1½ Mins. |
| (g) Final 10% of dry materials added to mixer. | |
| (h) Mix for 1 minute. (for lower densities 3–4 minutes of final mixing may be required). | 2½ Mins. |
| (i) Mix discharged into mould. | 3 Mins. |
| (j) Temperature of cast material starts to rise. | X mins. |
| (k) Mould table tipped and panel removed. | X + 1 Min. |

The wet gypsum strength is attained quite quickly after about the elapsed time of X minutes at which the temperature rise starts.

Test A

Using conventional techniques for comparison purposes, panels were made from each of the four mixes in the manner described above and test cubes were cut from them. The ambient temperature was 75° F and water at an initial temperature of 85° F was used. The elapsed time X was approximately 45 minutes for all four mixes and after removal from the mould, the panels were allowed to cure for 28 days in ambient air at a temperature varying between 75° and 60° F and in moist conditions and were subsequently dried by blowing with heated dried air.

Some of the cubes were compression tested approximately one hour after the datum time to give the wet strength achieved by the gypsum. Further cubes were tested after 28 days to give the strength after curing of the cement and the remainder of the cubes were tested after drying.

The following average compression test results were obtained:

TABLE A

| Mix | Example I | Example II | Example III | Example IV |
|---|---|---|---|---|
| Wet Gypsum strength (psi) | 1500 | 250 | 1000 | 200 |
| Cured Cement strength (psi) | 4250 | 1000 | 5000 | 2500 |
| Cured and dried strength (psi) | 4300 | 1050 | 5100 | 2550 |

The nett shrinkage of all the mixes after curing and drying was about 800 × $10^{-6}$ in/in.

Test B

Panels were again made from each of the four mixes in the manner described above and test cubes were cut from them. The ambient temperature was 75° F and again water at an initial temperature of 85° F was used. In this example, though, the moulds were heat insulated to conserve the heat of reaction of the mix and the elapsed time X was reduced to approximately 30 minutes for the mixes of Examples I and III and to approximately 40 minutes for the mixes of Examples II and IV. After one hour from the datum time, at which time the temperature of the panels had risen to from 106° F to 108° F, the panels were placed in the jacket structure where they were maintained at a temperature of 106° F for a period of 18 hours in an atmosphere of 100% relative humidity. After this drying air was passed through the jacket structure.

Some cubes cut from the panels were compression tested at the time of transfer of the remainder of the panels to the jacket structure and further cubes were cut from the panels and were tested both immediately before and after the 12 hour drying period.

The following average compression test results were obtained:

TABLE B

| Mix | Example I | Example II | Example III | Example IV |
|---|---|---|---|---|
| Wet Gypsum strength (psi) | 1750 | 300 | 1100 | 250 |
| Cured Cement strength (psi) | 4450 | 1100 | 5000 | 2600 |
| Cured and dried strength (psi) | 4750 | 1225 | 5650 | 3000 |

Test C

Panels were made from the mixes of Example I, II and IV in the manner described above and cubes were cut from them. The ambient temperature was 75° F but in this instance the mixing water was pre-heated to 125° F. The moulds were again heat insulated and the elapsed time X was greatly reduced to approximately 10 minutes for all three mixes. Thus setting of the gypsum occurred directly after the wet mixes had been introduced into the moulds. As soon as the panels had been removed from the mould after X + 1 minutes the panels were introduced into the compartments of the jacket structure. All the panels quickly reached temperatures of approximately 170° F without any further energy supply. The jacket structure was kept closed for 4½ hours and after this dried ambient air was blown through the jacket structure at a surface speed over the panels of 20 miles per hour for a further 4½ hours. This cooled the panels and reduced their temperatures steadily to the ambient temperature of 75° F.

The cube compression test results taken at datum time plus 1 hour and at the end of the drying period were:

TABLE C

| Mix | Example I | Example II | Example IV |
|---|---|---|---|
| Wet Gypsum strength (psi) | 1800 | 1200 | 325 |
| Cured and dried strength (psi) | 5300 | 6150 | 3500 |

The nett shrinkage of all three mixes after curing and drying was about 500 × $10^{-6}$ in/in.

From a comparison of these three tests, it will be seen that even when the temperature of the initial mix placed in the moulds is near the lower limit, a very marked increase in the rate at which compressive strength of the cement content of the mix occurs is brought about by the method in accordance with the invention in which both the dissipation of heat and moisture from the set mixture is controlled. What is more, the compressive strength eventually achieved by each mix is increased by at least 10%.

By using an initial mix temperature near the upper end of the range, as is preferred, it will be seen that the rate of gain of compressive strength is even more markedly increased and the ultimate tensile strength rises still further. Moreover the nett shrinkage of the casting, which initially expands as the gypsum is hydrated and then shrinks again as the cement is cured, is substantially reduced and, when a high initial mix temperature is used, the time for which the mix remains in the mould can be reduced to less than a third of that which is otherwise necessary. In consequence a substantial saving can be made in the number of moulds required for a given production rate.

When the initial temperature of the mix is raised to near the upper end of the range of from 80° to 130° F, the only extra energy required above that produced by the heat of reaction of the mix, is that necessary to heat the water, or alternatively the other ingredients of the mix, and subsequently to blow the cooling air through the insulating jacket structures. The cost of this additional energy is very small compared with the very considerable saving made by reducing the number of moulds required and reducing the storage time of the panels before they can be subjected to working stresses.

The use of the method in accordance with the invention for casting constructional panels has a number of still further advantages amongst which are that it is a simple matter to incorporate decorative effects on the exposed face of the panel. For instance, the exposed face of the panel can readily be made to simulate brickwork by providing a mould having a face shaped to provide the depressions formed by the joints between the bricks. Using such a mould, colouring matter is added to the mould in between the parts forming the joints before the fluid mixture is poured into the mould. The mixture in the parts of the mould between the brickwork joints is then coloured, but it remains uncoloured in the positions of the joints so that it has the appearance of forming the mortar between the bricks. As another possibility, two different batches of wet mix incorporating dyes of different colours may be poured in a random fashion into a mould and then, by roughly mixing the two batches of mix together, a marble or other rock-like visual effect can be achieved.

The deterioration of the hardened cement in the cast article which is caused by the gypsum content in the presence of water occurs because of a reaction between the sulphate radical in the gypsum and tricalcium aluminate in the cement. This reaction produces a growth of Ettringite crystals in the hardened cement giving rise to expansion and loss of strength. The problem is mitigated by the use of sulphate resistant cement which has a low tricalcium aluminate content of, for example, from 0.3 to 2% instead of up to 8% for normal Portland cement, but we have found that the addition of an acrylic resin emulsion to the composition in the amounts already described greatly decreases the crystal growth which is very advantageous.

Further, we have found that the crystal growth which occurs if the cast article becomes wet after it has once been dried can also be greatly decreased by carbonation of the composition whilst it is dry. For this purpose, after drying the panel or other casting in the jacket either by blowing air through the jacket or by suction, the jacket is preferably filled with carbon dioxide and the casting is kept in this gas for a time before removal for final atmospheric curing before use.

It has been found that two blocks or other articles made by the method in accordance with the invention can easily be stuck firmly to each other merely by interposing a thin layer of a fluid composition generally similar to that from which the articles are cast as an adhesive and allowing the layer to harden. The joint thus made may be as strong as the cast material itself. This phenomenon is extremely useful for jointing adjacent blocks or panels in a structure and it is equally useful for repair work.

We claim:

1. A method of making a cast article comprising the steps of:

a. mixing water with a composition comprising a binding agent containing, by weight, from 90% to 10% calcined gypsum and from 10 to 90% Portland cement, to produce a fluid mixture, at least one of said composition and said water being heated whereby said mixture has a temperature of from 70° to 130° F;

b. pouring said fluid mixture into a supporting device;

c. allowing a reaction between said calcined gypsum and said water in said mixture to cause said mixture to set in said supporting device, said reaction producing heat which causes the temperature of said mixture to begin to rise;

d. removing said mixture from said supporting device after said mixture has set sufficiently to be self supporting and thus form said cast article;

e. controlling the dissipation of both heat and moisture from said set mixture forming said cast article whereby the temperature of said set mixture rises to from 90° to 180° F; and, f. maintaining the temperature and moisture content of said set mixture for a period of at least two hours to cure said cement.

2. A method as claimed in claim 1, further comprising the step of drying said set mixture forming said cast article after said dissipation of heat and moisture has been controlled for said period of at least two hours.

3. A method as claimed in claim 2, wherein said step of drying said set mixture forming said cast article includes the step of applying a vacuum to at least a part of the surface of said cast article to suck moisture therefrom.

4. A method as claimed in claim 2, wherein said step of drying said set mixture forming said cast article includes the step of causing air to flow over at least a part of the surface of said cast article while the temperature of said cast article is still at least as high as 90° F.

5. A method as claimed in claim 1, wherein said dissipation of heat and moisture is controlled for at least three hours.

6. A method as claimed in claim 1, wherein said binding agent contains from about 40 to about 50% by weight of said calcined gypsum.

7. A method as claimed in claim 1, wherein said binding agent further comprises up to 15% by weight of Pozzolana cement.

8. A method as claimed in claim 1, wherein said Portland cement is sulphate resistant.

9. A method as claimed in claim 1, wherein said Portland cement has a specific surface of above 450 $m^2/Kg$.

10. A method as claimed in claim 1, further comprising the step of entraining air in said fluid mixture before said fluid mixture is poured into said supporting device.

11. A method as claimed in claim 10, wherein said composition further comprises an air entraining agent including sodium lauryl sulphonate in an amount not less than 0.01% by weight of said water in said mixture.

12. A method as claimed in claim 1, in which said calcined gypsum consists at least partly of high strength autoclaved $\alpha$ or $\alpha+$ gypsum.

13. A method as claimed in claim 1, wherein said step of mixing said composition and said water is performed in a rotary paddle mixer and includes the step of rotating a paddle of said mixer at a speed of at least 40 r.p.m.

14. A method as claimed in claim 1, wherein said composition further comprises reinforcing fibers.

15. A method as claimed in claim 14, wherein said fibers are of sisal and are present in an amount of up to 2% by weight of said binding agent.

16. A method as claimed in claim 1, further comprising the step of incorporating a fluidising agent in said fluid mixture.

17. A method as claimed in claim 16, wherein said fluidising agent is selected from the group consisting of sulphonated melamine formaldehyde resin and Gum Arabic and is present in an amount of from 0.1% to 2% by weight of said binding agent.

18. A method as claimed in claim 1, further comprising the step of incorporating in said fluid mixture a retarding agent for retarding the setting of said mixture.

19. A method as claimed in claim 18, wherein said retarding agent is sodium citrate and is present in an amount of up to 0.1% by weight of said binding agent.

20. A method as claimed in claim 1, further comprising the step of incorporating in said fluid mixture an accelerator for accelerating the setting of said mixture.

21. A method as claimed in claim 20, wherein said accelerator is potassium sulphate and is present in an amount of up to 0.1% by weight of said binding agent.

22. A method as claimed in claim 1, further comprising the step of sealing at least part of the surface of said cast article while said cast article is still moist and has a temperature of from 90° to 180° F by applying to said at least part of said surface a moisture curing liquid synthetic resin, allowing said liquid synthetic resin to be sucked by capillary action into said at least part of said surface and allowing said resin to be cured by moisture in said cast article and to be hardened by heat contained in said cast article.

23. A method as claimed in claim 22, wherein said liquid curing synthetic resin is polyurethane.

24. A method as claimed in claim 21, further comprising applying to a remaining part of said surface of said article which has not been sealed with said liquid curing synthetic resin, an acrylic resin emulsion.

25. A method as claimed in claim 1, further comprising the step of incorporating in said fluid mixture a wax resin emulsion in an amount of up to 2% by weight of said binding agent.

26. A method as claimed in claim 1, wherein said step of controlling said dissipation of heat and moisture includes the step of confining said cast article in a heat and moisture insulating jacket and thereby maintaining an atmosphere of 100% relative humidity around said cast article.

27. A method as claimed in claim 1 further comprising the step of incorporating an acrylic resin emulsion in said fluid mixture in an amount of up to 2% by weight of said binding agent.

* * * * *